US008777507B1

(12) United States Patent
Carey

(10) Patent No.: US 8,777,507 B1
(45) Date of Patent: Jul. 15, 2014

(54) COSMETIC APPLICATOR AND DISPENSER

(76) Inventor: Barbara Carey, Orinda, CA (US)

( * ) Notice: Subject to any disclaimer, the term of this patent is extended or adjusted under 35 U.S.C. 154(b) by 806 days.

(21) Appl. No.: 12/435,616

(22) Filed: May 5, 2009

Related U.S. Application Data

(60) Provisional application No. 61/126,313, filed on May 5, 2008.

(51) Int. Cl.
*A46B 11/04* (2006.01)

(52) U.S. Cl.
USPC ..... 401/284; 401/282

(58) Field of Classification Search
USPC ..... 401/268, 269, 282, 284, 195; 15/24, 29; 601/112, 17, 18
See application file for complete search history.

(56) References Cited

U.S. PATENT DOCUMENTS

| | | | | | |
|---|---|---|---|---|---|
| 1,247,484 | A * | 11/1917 | Albrecht | 15/24 |
| 1,372,308 | A | 3/1921 | MacRae | |
| 2,294,285 | A | 8/1942 | Chu | |
| 2,409,847 | A | 10/1946 | Gregg | |
| 3,030,967 | A * | 4/1962 | Peyron | 15/22.1 |
| 3,056,999 | A * | 10/1962 | Myddelton | 401/183 |
| 3,968,789 | A * | 7/1976 | Simoncini | 15/22.1 |
| 4,189,801 | A * | 2/1980 | Lanusse | 15/22.1 |
| 4,626,119 | A | 12/1986 | Ladd, Jr. | |
| 4,906,120 | A | 3/1990 | Sekiguchi et al. | |
| 4,974,981 | A | 12/1990 | Bennett | |
| 6,224,287 | B1 * | 5/2001 | Gieux | 401/282 |
| 7,758,525 | B2 * | 7/2010 | Thiebaut et al. | 601/112 |
| 8,033,746 | B2 * | 10/2011 | Tsai | 401/117 |
| 2006/0265821 | A1 * | 11/2006 | Hause | 15/22.1 |
| 2008/0014011 | A1 * | 1/2008 | Rossen | 401/195 |

* cited by examiner

*Primary Examiner* — David Walczak
*Assistant Examiner* — Jennifer C Chiang
(74) *Attorney, Agent, or Firm* — Haverstock & Owens LLP

(57) ABSTRACT

A cosmetic system includes a motorized applicator/dispenser with an applicator brush and a motorized handle unit for automatically moving the applicator brush in one or more directions. A cosmetic container unit containing a cosmetic is in communication with the applicator brush and the cosmetic is wicked or dispensed onto the skin when the applicator brush comes into contact with the skin and the applicator brush is automatically moved in one or more directions. In some embodiments, the motorized applicator/dispenser includes touch control for controlling the movement of the applicator brush.

12 Claims, 2 Drawing Sheets

COSMETIC APPLICATOR AND DISPENSER

RELATED APPLICATION(S)

This Patent Application claims priority under 35 U.S.C. 119 (e) of the U.S. Provisional Patent Application Ser. No. 61/126,313, filed May 5, 2008, and entitled "COSMETIC APPLICATOR AND DISPENSER." The Provisional Patent Application Ser. No. 61/126,313, filed May 5, 2008, and entitled "COSMETIC APPLICATOR AND DISPENSER" is also hereby incorporated by reference.

FIELD OF THE INVENTION

This invention relates generally to cosmetics. More specifically, this invention relates to systems and devices for applying and dispensing cosmetics.

BACKGROUND ON INVENTION

Cosmetics refer to a group of substances or mixtures of materials that are applied to portions of a persons body to alter their appearance, provide a fragrance and/or to protect skin and hair. Cosmetics include; skin-care creams, lotions, powders, perfumes, lipsticks, fingernail and toenail polishes, eye and facial makeup, permanent waves, colored contact lenses, hair colors, hair sprays and gels, deodorants, baby products, bath oils, bubble baths, bath salts, butters and many other types of products.

A number of cosmetics, especially those cosmetics referred to as "make-up", are applied using multi-use or single-use brushes, sponges, or pad applicators. A facial cosmetic system often includes a loose applicator that is stored within a cosmetics case (compact) along with a cosmetic. In these facial cosmetic systems, the applicator often becomes coated or soiled with the cosmetic while the compact is carried in a purse, backpack or pocket. Further, these applicators tend to get lost or separated from the compact while being carried around or during use.

SUMMARY OF THE INVENTION

The present invention is directed to a system for applying a cosmetic to skin. The system includes an applicator/dispenser unit. The applicator/dispenser unit has an applicator brush, a handle unit and a cosmetic container unit with a cosmetic contained therein. The cosmetic container unit is utilized with the applicator brush such that the cosmetic is applied to skin through the applicator brush when the applicator brush is brought in contact with skin.

In some embodiments, the handle unit includes a motor to automatically move the applicator brush. In accordance with this embodiment, the handle unit further includes a switch or touch control panel for controlling movement of the applicator brush. In some embodiments, the applicator brush is configured to move with a back-and-forth motion, a rotational motion or a vibrational motion. The motor of the handle unit is powered by a battery, which is permanent, replaceable and/or configured to be recharged by a charger unit that plugs into an electrical outlet.

In further embodiments, the cosmetic container unit is configured to detachably couple to the handle unit. Accordingly, a user is able to replace or exchange the cosmetic container unit with a new cosmetic container unit having the same or a different cosmetic contained therein. The cosmetic contained within the cosmetic container unit is a cosmetic filler such as but not limited to powder cosmetic, liquid cosmetic or semi-liquid cosmetic.

In accordance with some embodiments, a system includes a motorized applicator/dispenser with an applicator brush and motorized handle unit for automatically rotating and or otherwise moving the applicator brush in a direction. The system further includes a cosmetic container unit for holding a cosmetic, wherein the cosmetic is in communication with the applicator brush and is applied to skin when the applicator brush is automatically brushed with a rotary motion against the skin.

In still further embodiments, the system includes a touch control for controlling the rotational direction of the applicator brush and/or the speed of rotation of the applicator brush. The motorized handle unit includes a power supply. The motorized unit also includes the cosmetic container unit that can be configured to detachably couple to the motorized handle unit.

In accordance with a method of some embodiments, a cosmetic is applied to skin by providing a cosmetic container unit with a cosmetic contained therein. The cosmetic container unit is coupled to a motorized handle unit and an applicator brush. The applicator brush is then revolved with contact tips of the applicator brush against the skin and the cosmetic is applied to the skin by wicking through a back portion of the applicator brush, through bristle bodies of the applicator brush and onto the contact tips of the applicator brush.

DETAILED DESCRIPTION OF THE PREFERRED EMBODIMENTS

Figure 1A:
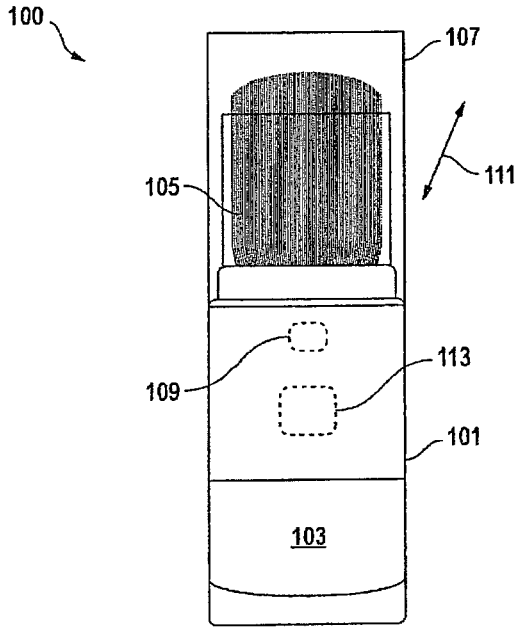
FIG. 1A shows a cosmetics system, in accordance with some embodiments.
Figure 1B:
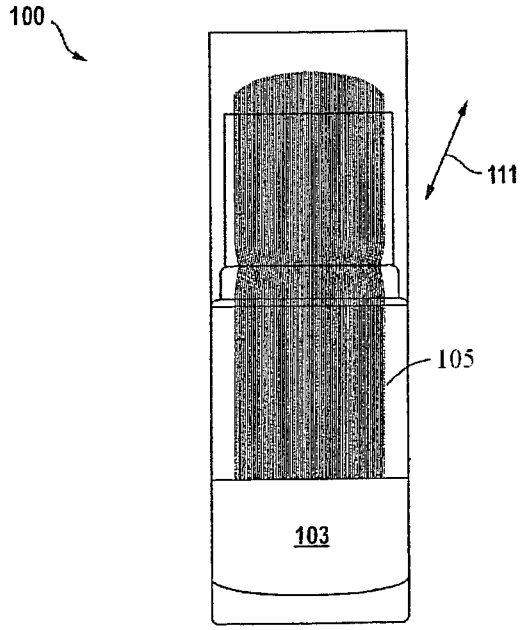
FIG. 1B shows a cosmetics system with a cosmetic is in communication with the applicator brush, in accordance with some embodiments.

An improved cosmetic system is illustrated in FIG. 1. A system includes an applicator/dispenser unit 100. The applicator dispenser unit 100 has an applicator brush 105, a handle unit 101 and a cosmetic container unit 103 with a cosmetic contained therein. The cosmetic container unit 103 is in communication with the applicator brush 105, such that the cosmetic is applied to skin through the applicator brush 105 when the applicator brush 105 is brushed against skin.

Still referring to FIG. 1, some embodiments, the handle unit 101 includes a motor 109 configured to automatically move the applicator brush 105 in one or more directions, as indicated by arrow 111. In accordance with this embodiment, the handle unit 101 further includes a switch or touch control 113 for controlling one or more of the speed of the movement of the applicator brush 105 or the direction of the movement of the applicator brush 105. In some embodiments, the applicator brush 105 is configured to move in a back-and-forth motion, a rotational motion or a vibrational motion. The motor 109 of the handle unit 101 is powered by a battery (not shown), which is permanent and/or replaceable. In other embodiments, the motor 109 of the handle unit 101 is powered by a battery that is configured to be recharged by a charger unit (not shown) that plugs into an electrical outlet.

Again referring to FIG. 1, in accordance with further embodiments, the cosmetic container unit 103 is configured to detachably couple to the handle unit 101. Accordingly, a user is able to replace or exchange the cosmetic container unit 103 with a new cosmetic container unit having the same or different cosmetic product contained therein. The cosmetic within the cosmetic container unit 103 is powder cosmetic, liquid cosmetic or semi-liquid cosmetic. In some embodiments, a cover 107 is included that is configured to protect the applicator brush 105 during storage.

Figure 2:
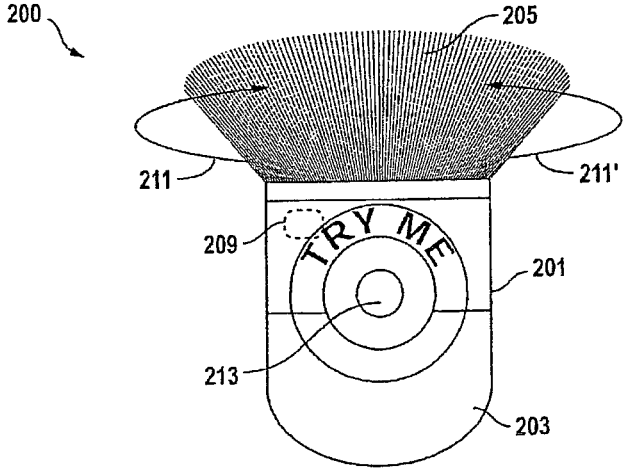
FIG. 2 shows a cosmetic system with a rotary brush applicator, in accordance with some embodiments.

Referring now to FIG. 2, in some embodiments, a system includes a motorized applicator/dispenser 200 with an applicator brush 205. The motorized applicator/dispenser 200 has a motorized handle unit 201 with a motor 209 for automatically rotating the applicator brush in one or more rotational directions, as indicated by the arrows 211 and 211'. The system further includes a cosmetic container unit 203 for holding a cosmetic, wherein the cosmetic is in communication with the applicator brush 205 and is applied to skin through the applicator brush 205 when the applicator brush is placed against the skin with a rotary motion, as indicated by one or more of the arrows 211 and 211'. In still further embodiments, the motorized applicator/dispenser 200 is configured to oscillate the applicator brush 205 back-and-forth between the rotational directions, as indicated by the arrows 211 and 211'. In accordance with still further embodiments, the motor is configured to automatically move the applicator brush 205 in any number of directions.

In some embodiments, a touch control 213 is included for controlling the rotational direction of the applicator brush 205 and/or the speed of rotation of the applicator brush 205. The motorized handle unit 201 is powered by a battery (not shown), which is permanent and/or replaceable. In other embodiments, the motorized handle unit 201 is powered by a battery that is configured to be recharged by a charger unit (not shown) that plugs into an electrical outlet.

In some embodiments, the cosmetic container unit 203, is configured to detachably couple to the motorized handle unit 201. It will be clear to one skilled in the art that the container unit 203 and the motorized handle unit 201 are able to be configured to detachably couple through any number of different securing features to provide user feedback. For example, the container unit 203 and the motorized handle unit 201 are able to include ribbed features capable of being press fitted together.

The automatic movement of the applicator brush such as described in detail above, helps to infuse the cosmetic into the skin and provides for a long lasting uniform application of the cosmetic to the skin.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the system of the present invention could be implemented in several different ways and the apparatus disclosed above is only illustrative of the preferred embodiment of the invention and is in no way a limitation.

What is claimed is:

1. A system comprising an applicator/dispenser unit, the system comprising:

a. an applicator brush;

b. a motorized handle unit for automatically rotating the applicator brush in a selectable direction; and c. a cosmetic container unit in communication with the applicator brush and having a cosmetic contained therein, wherein the applicator brush contacts the interior of the cosmetic container unit such that the cosmetic wicks directly from the cosmetic container unit into the applicator brush when the brush is brushed against a user's skin.

2. The system of claim 1, wherein the handle unit comprises a touch control panel for controlling movement of the applicator brush.

3. The system of claim 1, wherein the motorized handle unit automatically moves the applicator brush with a back-and-forth motion, a rotational motion or a vibrational motion.

4. The system of claim 1, wherein the cosmetic container unit is configured to detachably couple to the handle unit.

5. The system of claim 1, wherein the cosmetic is powder cosmetic, liquid, cosmetic or semi-liquid cosmetic.

6. A system comprising:

a. a motorized applicator/dispenser, the motorized applicator/dispenser comprising:

1. an applicator brush with a brush head;

2. a motorized handle unit for automatically rotating the applicator brush in a selectable direction; and b. a cosmetic container unit for holding a cosmetic, wherein the cosmetic container unit is in communication with the applicator brush and the applicator brush contacts the interior of the cosmetic container unit such that the cosmetic wicks directly from the cosmetic container unit into the applicator brush when the brush is brushed against a user's skin.

7. The system of claim 6, wherein the motorized handle unit includes a touch control panel for controlling one or more of a rotational direction of the applicator brush and a speed of rotation of the applicator brush.

8. The system of claim 6, wherein the motorized handle unit includes a power supply.

9. The system of claim 6, wherein the cosmetic container unit detachably couples to the motorized handle unit.

10. A method of applying a cosmetic to skin, the method comprising:

a. providing a cosmetic container unit with a cosmetic therein;

b. coupling the cosmetic container unit to a motorized handle unit and an applicator brush, wherein the applicator brush has one or more contact tips; and c. revolving the applicator brush with one or more contact tips against the skin, wherein the cosmetic is applied to the skin by wicking directly from the cosmetic container unit to a back portion of the applicator brush, and through or along bristle bodies of the applicator brush onto the contact tips of the applicator brush.

11. A system comprising an applicator/dispenser unit, the system comprising:

a. an applicator brush;

b. a motorized handle unit for automatically rotating the applicator brush in a selectable direction; and c. a cosmetic container unit having a cosmetic contained therein, wherein the cosmetic is in contact with the applicator brush such that the cosmetic is wicked out of the cosmetic container by the applicator brush when the brush is brushed against the skin.

12. The system of claim 1 wherein the cosmetic is only wicked when the brush is brushed against the user's skin.

* * * * *